US008430107B2

(12) United States Patent
Huang

(10) Patent No.: US 8,430,107 B2
(45) Date of Patent: Apr. 30, 2013

(54) FOAM OUTPUT DEVICE EASY TO PRODUCE FOAM

(75) Inventor: Ching-Sen Huang, Chiayi County (TW)

(73) Assignee: Yu Chang Esthetics Consultant Co., Ltd., Chiayi County (TW)

( * ) Notice: Subject to any disclaimer, the term of this patent is extended or adjusted under 35 U.S.C. 154(b) by 175 days.

(21) Appl. No.: 13/046,015

(22) Filed: Mar. 11, 2011

(65) Prior Publication Data

US 2012/0228332 A1 Sep. 13, 2012

(51) Int. Cl.

| | |
|---|---|
| ***A45D 24/22*** | (2006.01) |
| ***A45D 44/00*** | (2006.01) |
| ***B67D 7/76*** | (2010.01) |
| ***B65D 37/00*** | (2006.01) |

(52) U.S. Cl.

USPC ..... 132/113; 132/112; 132/333; 222/190; 222/209; 222/211

(58) Field of Classification Search ..... 132/113, 132/333, 290, 200, 212, 112, 115, 289, 286, 132/299, 306, 307, 320, 902; 222/146.5, 222/190, 206, 207, 211, 212, 213, 189.06, 222/189.11, 320, 321.1; 510/140, 279; 239/310, 239/311, 356, 334, 354, 367, 368, 571, 572, 239/363, 372, 464, 327, 575, DIG. 23

See application file for complete search history.

(56) References Cited

U.S. PATENT DOCUMENTS

| | | | | |
|---|---|---|---|---|
| 4,773,570 | A * | 9/1988 | Workum | 222/190 |
| 5,000,199 | A * | 3/1991 | Kuranski et al. | 132/112 |
| 5,048,750 | A * | 9/1991 | Tobler | 222/190 |
| 5,219,102 | A * | 6/1993 | Wright | 222/190 |
| 5,310,093 | A * | 5/1994 | Bennett | 222/190 |
| 6,009,881 | A * | 1/2000 | Baudin et al. | 132/112 |
| 6,315,168 | B1 * | 11/2001 | Bolyard et al. | 222/189.06 |
| 6,394,315 | B1 * | 5/2002 | Banks | 222/190 |
| 6,446,840 | B2 * | 9/2002 | Ophardt et al. | 222/190 |
| 6,505,986 | B1 * | 1/2003 | Oder | 401/183 |
| 6,868,990 | B2 * | 3/2005 | Cater et al. | 222/190 |
| 7,490,614 | B2 * | 2/2009 | Hayakawa et al. | 132/112 |
| 7,841,793 | B2 * | 11/2010 | Ramet | 401/11 |
| 7,850,048 | B2 * | 12/2010 | Arminak | 222/190 |
| 8,118,036 | B2 * | 2/2012 | Wang et al. | 132/113 |
| 2002/0153389 | A1 * | 10/2002 | Creaghan et al. | 222/190 |
| 2003/0015552 | A1 * | 1/2003 | Bistolfi | 222/145.6 |
| 2005/0098581 | A1 * | 5/2005 | Long et al. | 222/190 |
| 2005/0284887 | A1 * | 12/2005 | Lewis et al. | 222/181.3 |
| 2006/0219738 | A1 * | 10/2006 | Ilzuka et al. | 222/190 |

(Continued)

FOREIGN PATENT DOCUMENTS

JP 7-215353 A 8/1995

*Primary Examiner* — Vanitha Elgart
(74) *Attorney, Agent, or Firm* — Rosenberg, Klein & Lee

(57) ABSTRACT

A foam output device easy to produce foam is composed of a nozzle seat, a one-way air intake valve, a nozzle and a filter. When conducting assembly, the filter is firstly set into the housing aperture of the nozzle seat. In turn, an through hole of the one-way air intake valve is engaged with sleeve of the nozzle seat, then the nozzle is assembled on the nozzle seat in such a manner that a clamping pieces of the nozzle clamp the coupling tabs on the nozzle seat, and that a hook on the clamping piece is in hooking engagement with a hook on the coupling tabs so as to fix together. The assembly of the present invention is thus completed in simple manner. In this way, a foam output device having simple element constitution, easy assembly and low manufacturing cost is thus provided.

9 Claims, 10 Drawing Sheets

U.S. PATENT DOCUMENTS

2009/0039111 A1* 2/2009 Tu ..... 222/190
2010/0001024 A1* 1/2010 van der Heijden ..... 222/190
2010/0193547 A1* 8/2010 Laidler et al. ..... 222/190
2010/0320232 A1* 12/2010 van der Heijden et al. ... 222/135
2011/0006086 A1* 1/2011 Yates ..... 222/190
2011/0036869 A1* 2/2011 Arminak ..... 222/190
2011/0272488 A1* 11/2011 Baughman ..... 239/311
2011/0284421 A1* 11/2011 Lane et al. ..... 206/581
2011/0284587 A1* 11/2011 Galazka et al. ..... 222/190
2012/0160879 A1* 6/2012 Ciavarella et al. ..... 222/409
2012/0217267 A1* 8/2012 Bunoz et al. ..... 222/145.5
2012/0246856 A1* 10/2012 Screnci et al. ..... 15/160

* cited by examiner

FOAM OUTPUT DEVICE EASY TO PRODUCE FOAM

BACKGROUND OF INVENTION

1. Field of invention

The present invention relates to a foam output device easy to produce foam, more particularly to a foam output device having simple element constitution, easy assembly and low manufacturing cost.

2. Brief Description of Prior Art

Referring to Japanese Patent Gazette Hei 7-215353 entitled "Foam Dispensing Container", it comprises a cap nozzle, a cap main body, a valve diaphragm, a filter net, a retaining ring and a straw sleeve. When in assembly, the filter net and the retaining ring are pre-assembled into the straw sleeve, then the valve diaphragm and the straw sleeve pre-assembled with the filter net and the retaining ring are set into the cap main body. In turn, the cap nozzle and the cap main body are assembled together, and then a straw is inserted into the bottom of the straw sleeve. Configuring in this manner, when the bottle body is squeezed to push air flowing from the cap main body to the bottle body through the valve diaphragm, the air entering the bottle body is mixed with the solution inside, and then foam is dispensing out after the mixed solution is filtered by the filter net. However, it is apparent from the assembly procedure of the above foam dispensing container that the foam dispensing container is composed of a plurality of components. Hence, the assembly is time-consuming. In addition, part of the components is very tiny so that they are easy to drop down or to get lost during assembly. Not only big trouble is encountered in assembly process but also the loss of components means the increase of production cost. Moreover, in order to supply the plural components so as to keep up with the pace of production, more die sets have to be created to make the required quantities of components. These factors cause manufacturing cost staying in high and hence industrial competitiveness in low condition. Furthermore, as the components are very tiny, requirement on the assembly should be more precise, hence dislocation of each component and thus damage is more likely to happen. This will make the foam dispensing container fails to spit out foam smoothly.

SUMMARY OF INVENTION

This invention relates to a foam output device easy to produce foam, the main object is to provide a foam output device having simple element constitution, easy assembly and low manufacturing cost.

In order to achieve the above objects, the inventor of the present invention hereby presents the novel foam output device described as below. The foam output device easy to produce foam is composed of a nozzle seat, a one-way air intake valve, a nozzle and a filter. When conducting assembly, the filter is firstly set into housing aperture of the nozzle seat. In turn, through hole of the one-way air intake valve is engaged with sleeve of the nozzle seat, then the nozzle is assembled on the nozzle seat in such a manner that a clamping pieces of the nozzle clamp the coupling tabs on the nozzle seat, and that a hook on the clamping piece is in hooking engagement with a hook on the coupling tabs so as to fix together. The assembly of the present invention is thus completed in simple manner. In this way, a foam output device having simple element constitution, easy assembly and low manufacturing cost is thus provided.

DETAILED DESCRIPTION OF PREFERRED EMBODIMENTS

The objects, the technical contents and the expected effectiveness of the present invention will become more apparent from the detailed description of the preferred embodiments in conjunction with the accompanying drawings.

Figure 1:
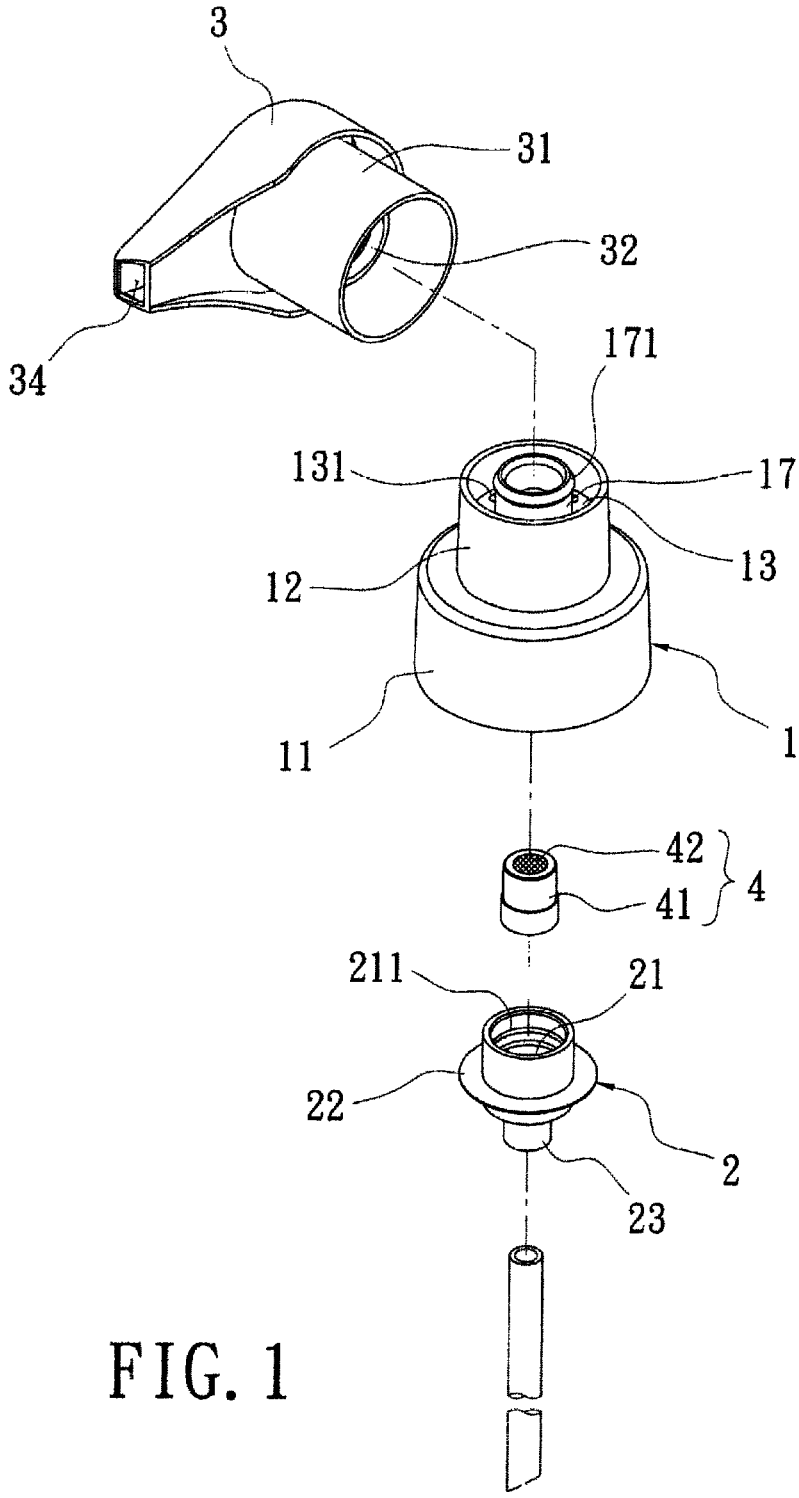
FIG. 1 is a perspective exploded view of the present invention.
Figure 2:
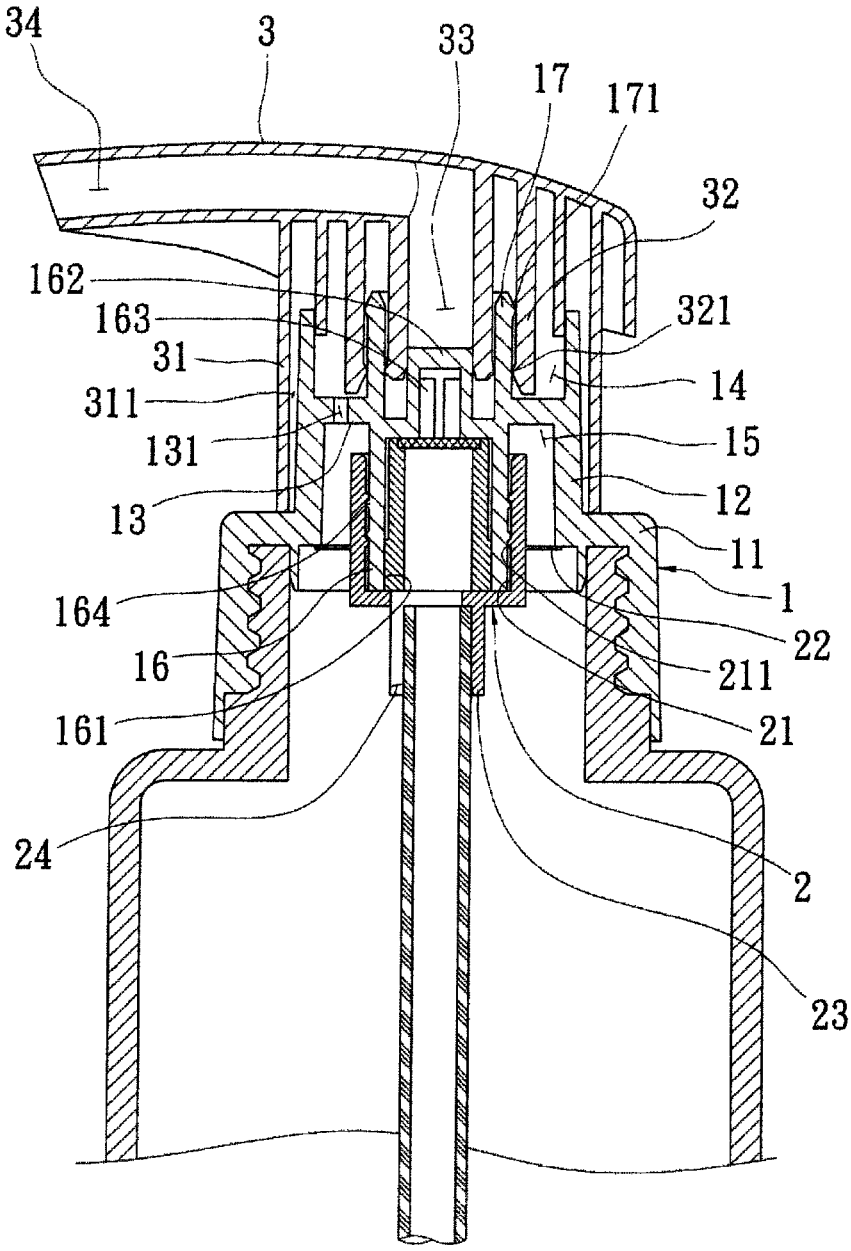
FIG. 2 is a sectional view of the present invention.

Firstly referring to FIGS. 1 and 2, the foam output device easy to produce foam of the present invention is formed by a nozzle seat (1), a one-way air intake valve (2), a nozzle (3) and a filter (4).

The nozzle seat (1) has a joint part (11), which can be an inner thread segment, and an assembly part (12) extended from the joint part (11). A partition plate (13) is provided within the assembly part (12) to separate the same into an upper chamber (14) and a lower chamber (15). A plurality of air vent (131) is provided on the partition plate (13) and a sleeve (16) is protruded from the center of the partition plate (13), a housing aperture (161) being formed at the center of the sleeve (16). Further, the sleeve (16) is extended upwardly to form a shrunken close end (162), and several perforations (163) are provided on the close end (162) so as to communicate with the housing aperture (161). Coupling tabs (17) are formed to extend upwardly from the partition plate (13), which have hook portions (171) provided at the outside of their upper edges.

The one-way air intake valve (2) has a through hole (21) provided at the center thereof for engagement with the sleeve (16) of the nozzle seat (1) and the one-way air intake valve (2) is located in the lower chamber (15) of the nozzle seat (1). Stop portions (211), (164) for positioning purpose are respectively provided on the peripheral walls of the through hole (21) of the one-way air intake valve (2) and the sleeve (16) mutually engaged therewith. A planar shape elastic diaphragm (22) formed on the one-way air intake valve (2) is parallelly abutted against the bottom edge of the lower chamber (15). A plurality of holding pieces (23) in flat and straight shape formed in mutually spaced manner for encircling and securely holding a straw is extended from the bottom of the one-way air intake valve (2), and gaps (24) are formed between the holding pieces (23) for communicating with the filter (4) housed within the sleeve (16).

The nozzle (3) is mounted over the nozzle seat (1) in such a manner that the outer wall (31) of the nozzle (3) is encircling the outside of the assembly part (12) of the nozzle seat (1), an air intake clearance (311) being formed between the outer wall (31) of the nozzle (3) and the assembly part (12) of the nozzle seat (1). Clamping pieces (32) are formed at the inside of the nozzle (3) for clamping the coupling tabs (17) of the nozzle seat (1). One of the clamping pieces (32) has a hook part (321) provided at the inside of its bottom edge for hooking engagement with the hook portions (171) provided on the coupling tabs (17) of the nozzle seat (1). A hollow buffer zone (33) opposite to the perforations (163) provided at the close end of the sleeve (16) is formed in the interior of the nozzle (3), and the hollow buffer zone (33) is communicated with the nozzle outlet (34) within which a filter net is provided.

The filter (4) is assembled in the housing aperture (161) provided on the sleeve (16) of the nozzle seat (1), which has a filter main body (41) and a filter net (42) to be integrally formed on the upper end of the filter main body (41) by injection molding.

Configuring like this, when conducting assembly as shown in FIGS. 1 and 2, the filter (4) is firstly set into the housing aperture (161) of the nozzle seat (1); in turn, the sleeve (16) of the nozzle seat (1) is engaged into the through hole (21) of the one-way air intake valve (2); then the nozzle (3) is assembled on the nozzle seat (1) in such a manner that the clamping pieces (32) clamp the coupling tabs (17) of the nozzle seat, and that the hook part (321) of the clamping pieces (32) conducts hooking engagement with the hook portions (171) of the coupling tabs (17); in this manner, the assembly of the present invention is completed in simple way. Next, a straw is clamped by the holding pieces (23) formed on the bottom of the one-way air intake valve (2), and then the straw is inserted into a flexible plastic bottle body having hair gel lotion, hair color lotion, body lotion, face cleanser or skin care product contained therein. Finally, the inner thread segment of the joint part (11) of the nozzle seat (1) is engaged with the outer thread segment provided on the outside of the bottle mouth of the bottle body.

Figure 3:
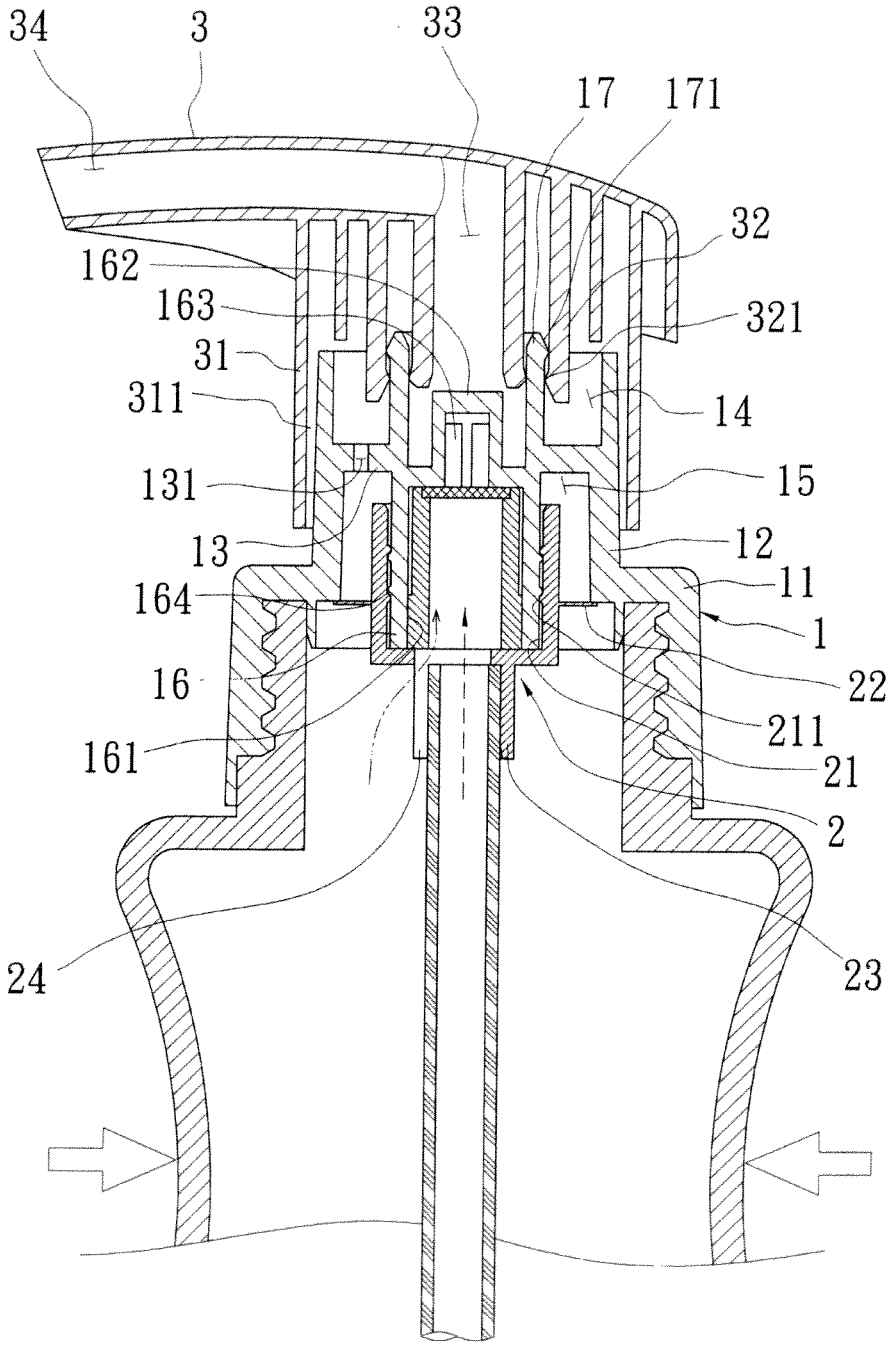
FIG. 3 is a view showing the state of usage of the present invention.

When in usage and implementation, as shown in FIGS. 3, the nozzle (3) assembled on the nozzle seat (1) is pulled upward so that ambient air can flow into the interior of the bottle body through the air intake clearance (311) formed between the assembly part (12) of the nozzle seat (1) and the outer wall (31) of the nozzle (3), the air vents (131) provided on the nozzle seat (1), and the one-way air intake valve (2). The air flowed from the air vents (131) completely act on the flat elastic diaphragm (22) having big area so as to push to open the elastic diaphragm (22) more quickly, and the air can flow into the interior of the bottle body so as to mix with the liquid contained therein.

When users apply force to press the bottle body, the pressure within the bottle body changes so that the air preserved within the bottle body is squeezed upwardly to flow to the filter (4) housed in the sleeve (16) through the gaps (24) formed between the holding pieces (23) of the one-way air intake valve (2).

In turn, the bottle body is continuously pressed to change the pressure inside, simultaneously the liquid contained therein is sucked by the straw to flow along the straw upwardly to the filter (4) housed in the sleeve (16). At this moment, the liquid flowed out from the straw is mixed with the air flowed into the filter (4) and is squeezed continuously by the air so as to be squeezed out toward the direction of the filter net (42) provided on the upper end of the filter (4). After the liquid mixed with air is squeezed out through the fine filter net (42), it is formed into foam and is squeezed out toward the direction of the buffer zone (33) of the nozzle (3) through the perforations (163) provided on the upper edge of the sleeve (16). For the time being, the foam squeezed out of the filter net (42) stops in the buffer zone (33) so as to stabilize its foam structure.

Next, the foam located in the buffer zone (33) is again squeezed by the air so as to be sprayed outwardly from the nozzle outlet (34) communicated with the buffer zone (33). Before the foam is sprayed out from the nozzle outlet (34), it is squeezed through another filter net provided in the nozzle outlet (34) so as to make the foam become more delicate and expanded after sprayed out from the nozzle outlet (34).

Figure 4:
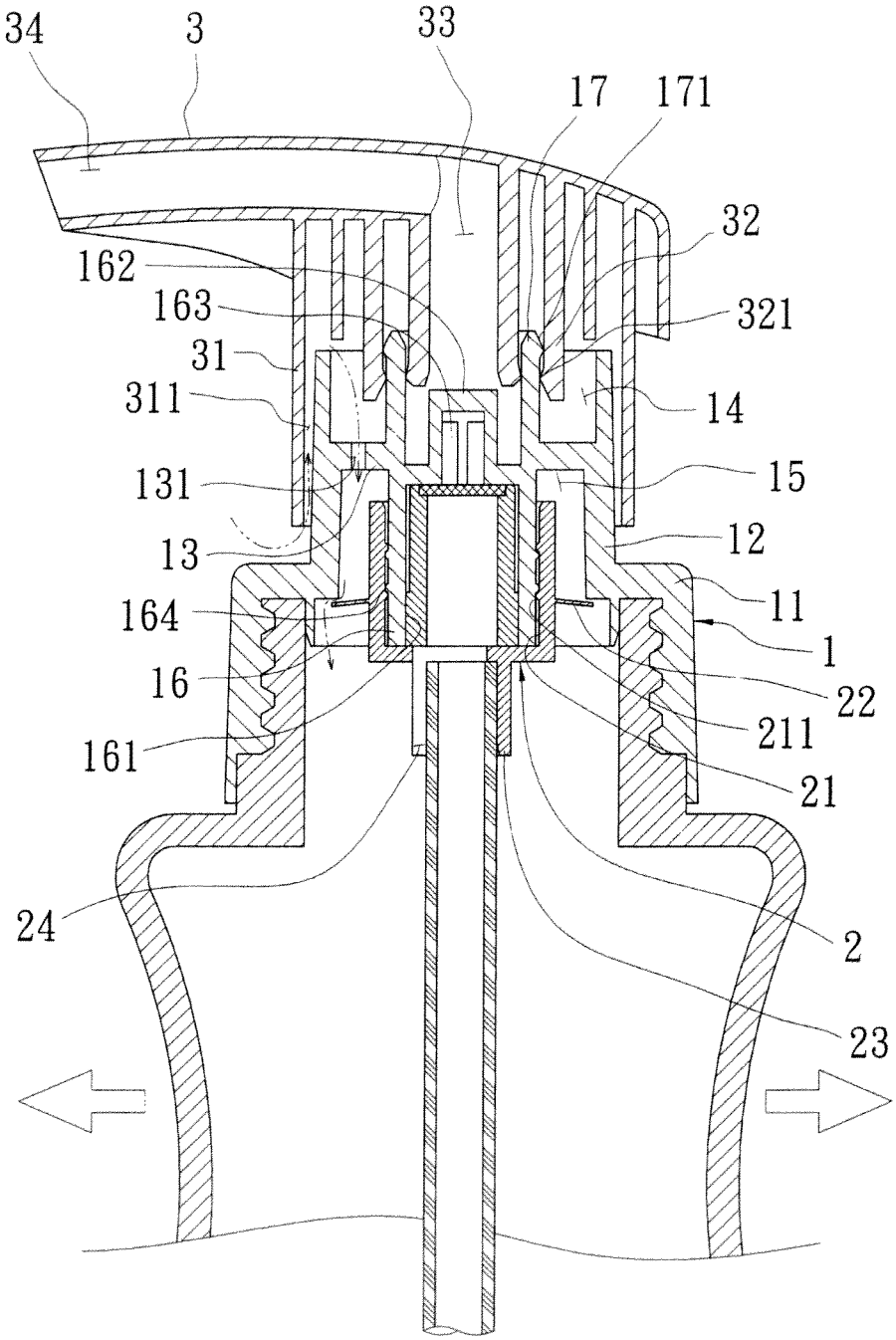
FIG. 4 is another view showing the state of usage of the present invention.

Referring to FIG. 4, when the squeezing force to the bottle body is released, suction force is produced in the interior of the bottle body so that ambient air is drawn into the bottle body through the air intake clearance (311) formed between the assembly part (12) of the nozzle seat (1) and the outer wall (31) of the nozzle (3), the air vents (131) provided on the nozzle seat (1), and then the air pushes to open the elastic diaphragm (22) abutted against the bottom edge of the lower chamber (15) so as to enter into the bottle body. After the passage of the air, the elastic diaphragm (22) of the one-way air intake valve (2) restores to its original state of abutting against the bottom edge of the lower chamber (15) by its elasticity, so as to preserve the air within the bottle body for next mixing with liquid contained therein under squeezing.

Configuring in this manner, quick assembly effect can be obtained by simple component design of the present invention having the nozzle seat (1), the one-way air intake valve (2), the nozzle (3) and the filter (4), and the volume of each component is formed to be grasped easily by users for assembly purpose, therefore, loss of components can be avoided in assembly. Moreover, as the component of the present invention is designed to be very simple, only four die sets are needed to produce the components required for assembly. Hence, manufacturing cost can be remarkably reduced so as to raise its industrial competitiveness.

Figure 5:
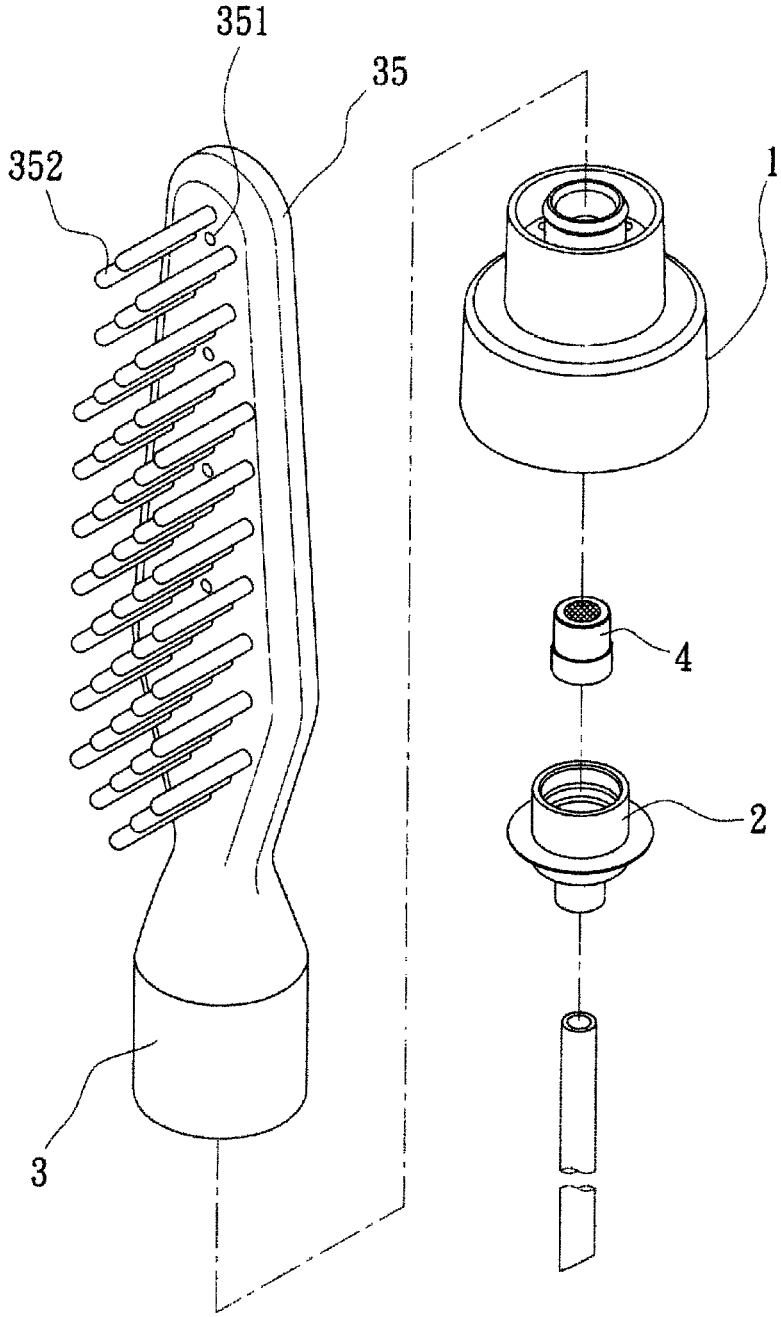
FIG. 5 is a perspective exploded view showing the first embodiment of the present invention.
Figure 6:
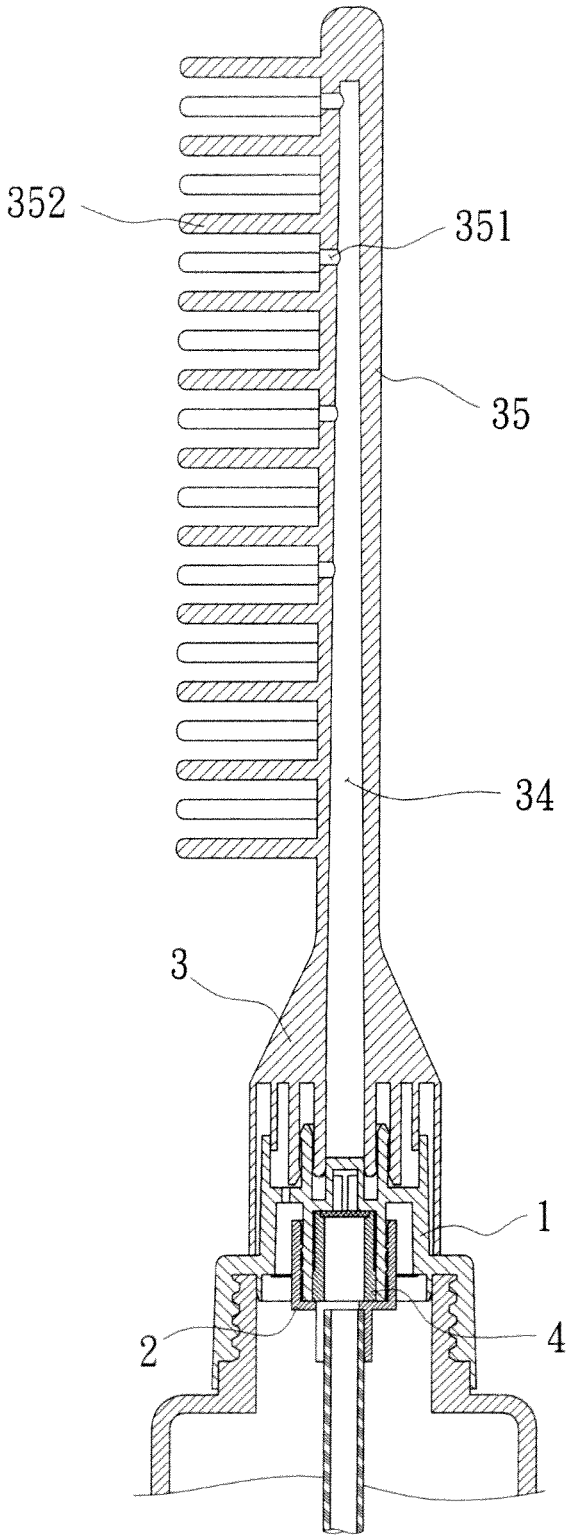
FIG. 6 is a sectional view showing the first embodiment of the present invention.

Further referring to FIGS. 5 and 6, a comb body (35) is extended from the upper end of the nozzle (3) and the nozzle outlet (34) is extended into the inside of the comb body (35). A plurality of perforations (351) is provided on the comb body (35) to communicate with the nozzle outlet (34). Configuring in this manner, when users comb their hair by the comb teeth (352), users can squeeze the foam out from the nozzle outlet (34) through the communicating perforations (351) onto the comb body (35) and then use the comb body (35) having foam attached therewith to comb the hair, so that the foam can be uniformly distributed on users' hair according to user's combing action.

Figure 7:
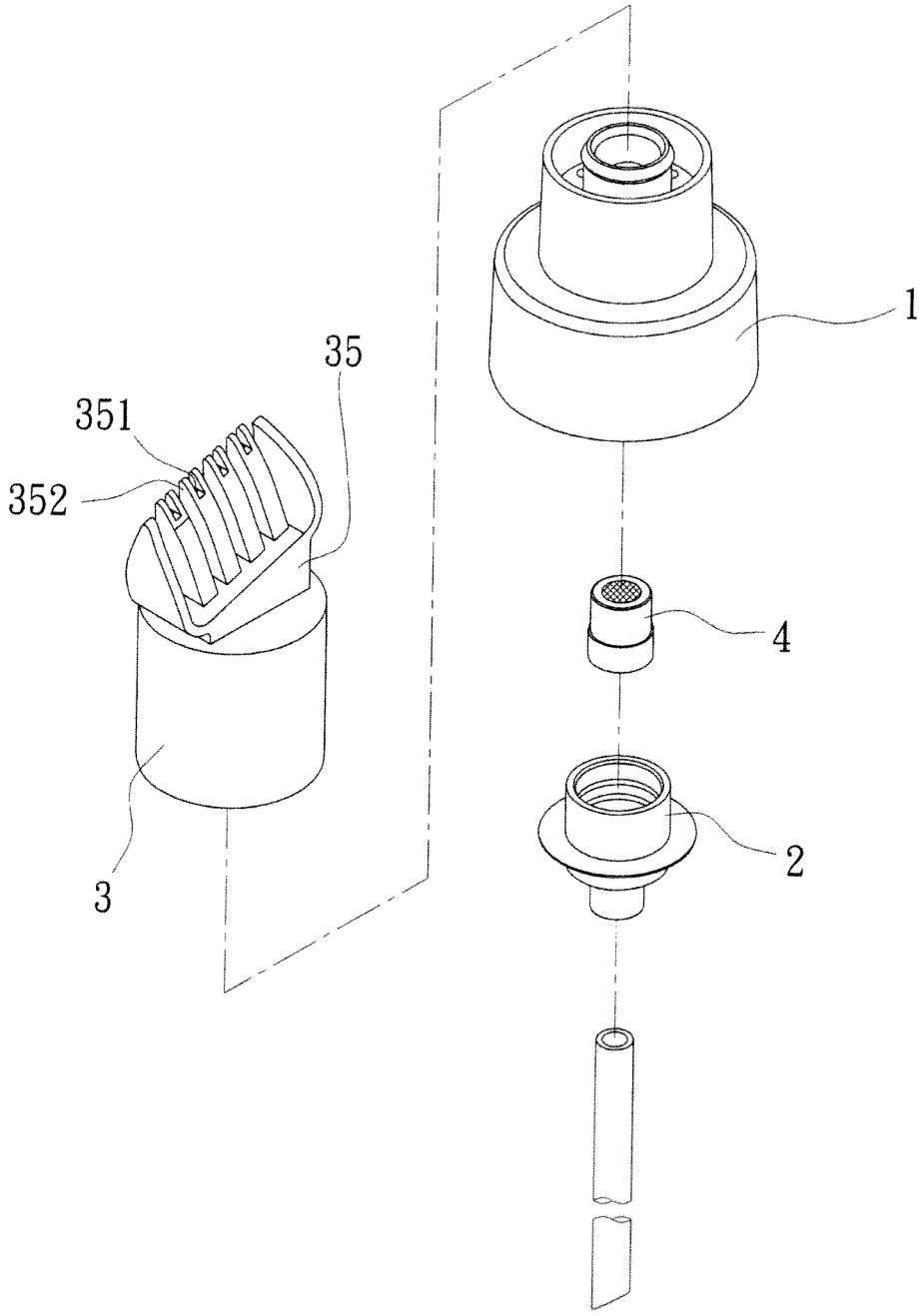
FIG. 7 is a perspective exploded view showing the second embodiment of the present invention.
Figure 8:
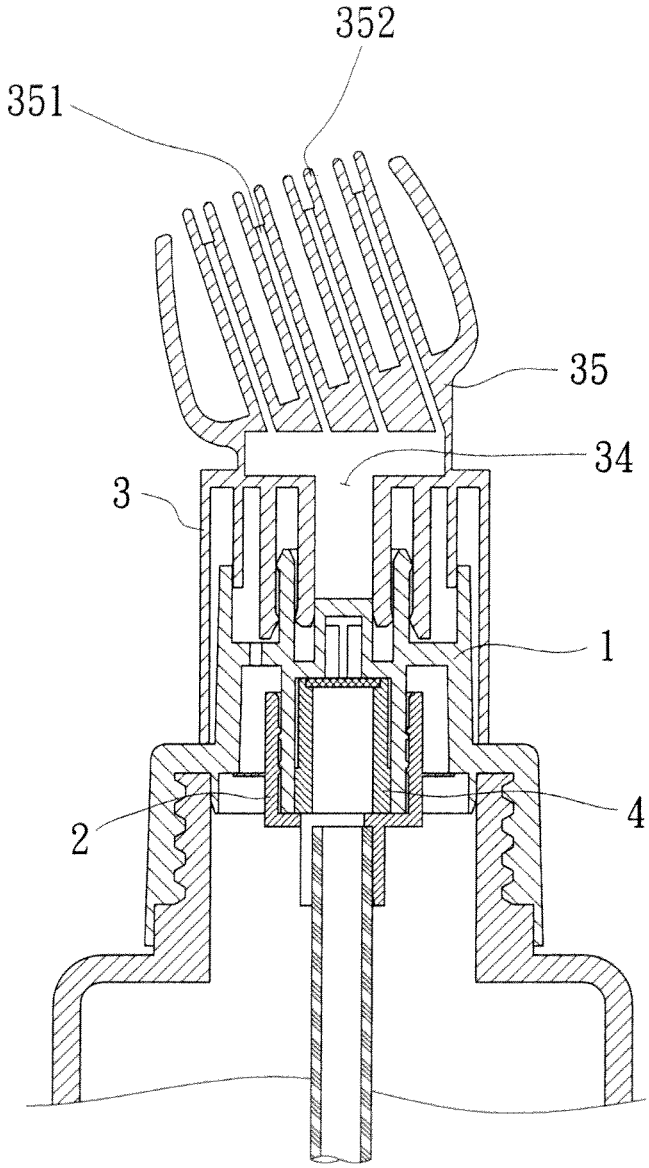
FIG. 8 is a sectional view showing the second embodiment of the present invention.

Further referring to FIGS. 7 and 8, in which another embodiment of the comb body (35) formed on the upper end of the nozzle (3) is shown. The comb body (35) has perforations (351) formed on the end portions of the comb teeth (352) and the perforations (351) are communicated with the nozzle outlet (34), so that foam can be outputted from the perforations (351) on the end portions of the comb teeth (352) during hair combing so as to dispense foam uniformly on hair.

Figure 9:
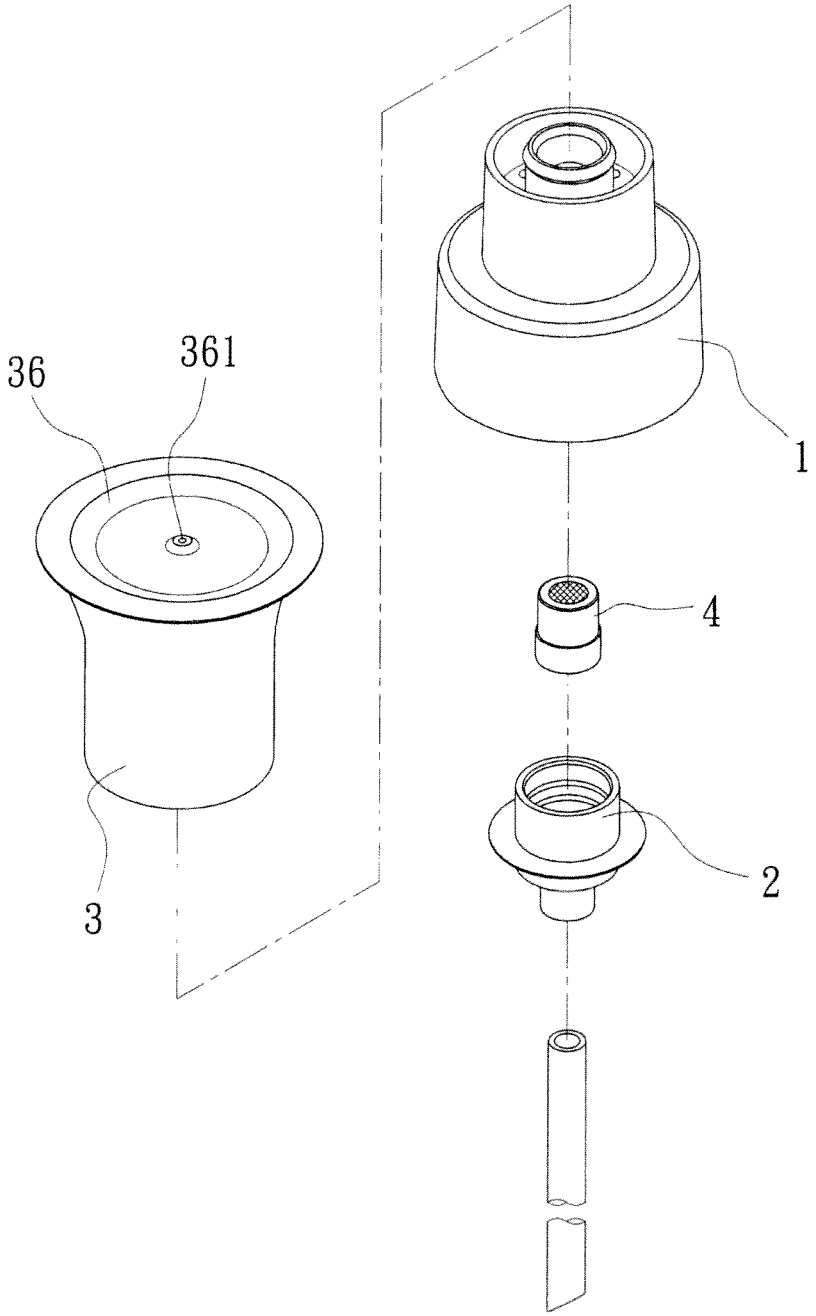
FIG. 9 is a perspective exploded view showing the third embodiment of the present invention.
Figure 10:
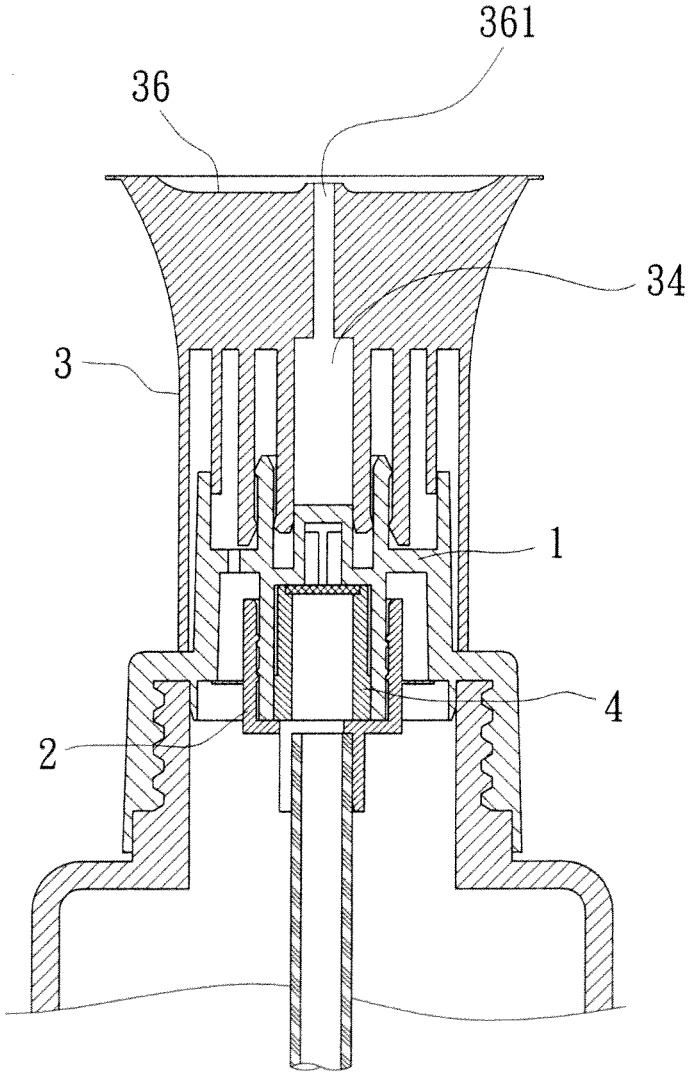
FIG. 10 is a sectional view showing the third embodiment of the present invention.

Further referring to FIGS. 9 and 10, a disk type end face (36) concaved from outside toward inside is formed on the upper end of the nozzle (3), and perforations (361) are formed on the center of the disk type end face (36) to communicate with the nozzle outlet (34). When the foam is squeezed out from the nozzle outlet (34), the foam can be collected on the disk type end face (36) through the perforations (361) to form cluster foam which can facilitate users to use.

What is claimed is:

1. A foam output device easy to produce foam, comprising:

a nozzle seat on which a joint part is formed, an assembly part being extended upwardly from said joint part;

a partition plate provided within said assembly part to separate the same into an upper chamber and a lower chamber;

a sleeve provided at the center of said partition plate;

an air vent provided on said partition plate and a one-way air intake valve provided below said partition plate, said one-way air intake valve having a through hole for engagement with said sleeve;

a planar shape elastic diaphragm formed on a peripheral wall of said one-way air intake valve, said elastic diaphragm being abutted parallelly against a bottom edge of said lower chamber;

a plurality of holding pieces having flat and straight shape formed and positioned in mutually spaced manner to encircle and securely hold a straw, said holding pieces extend from the bottom of said one-way air intake valve and with gaps formed between said holding pieces for communicating with a filter housed within a housing aperture of said sleeve;

a plurality of perforations provided on an upper edge of said sleeve to communicate with a foam buffer zone provided within a nozzle mounted over said nozzle seat, said nozzle having a nozzle outlet to communicate with said foam buffer zone.

2. A foam output device easy to produce foam as claimed in claim 1, wherein a comb body is extended from an upper end of said nozzle and comb teeth are provided on said comb body, said nozzle outlet being extended into the inside of said comb body, a plurality of perforations being provided through said comb body to communicate with said nozzle outlet.

3. A foam output device easy to produce foam as claimed in claim 1, wherein a comb body is extended from an upper end of said nozzle and comb teeth are provided on said comb body, said nozzle outlet being extended into the inside of said comb body, a plurality of perforations being provided through said comb teeth to provide communication between said nozzle outlet and upper ends of said comb teeth.

4. A foam output device easy to produce foam as claimed in claim 1, wherein a disk type end face concaved from outside toward inside is formed on an upper end of said nozzle, and perforations are formed on the center of said disk type end face to communicate with said nozzle outlet.

5. A foam output device easy to produce foam as claimed in claim 1, wherein stop portions formed as annular ridges are respectively provided on peripheral walls of said through hole of said one-way air intake valve and said sleeve engaged therewith.

6. A foam output device easy to produce foam as claimed in claim 5, wherein said filter has a filter main body and a filter net to be integrally formed on an upper end of said filter main body by injection molding.

7. A foam output device easy to produce foam as claimed in claim 6, wherein an air intake clearance is formed between an outer wall of said nozzle and said assembly part of said nozzle seat; an annular clamping piece being formed at the inside of said nozzle and said clamping piece having a hook part provided at a bottom edge of said clamping piece; an annular coupling tab being formed to extend upwardly from said partition plate of said nozzle seat, said coupling tab has a hook portion provided at an upper edge of said coupling tab; said clamping piece being used to clamp said coupling tab and said hook part provided at the bottom edge of said clamping piece being in hooking engagement with the hook portion provided on said coupling tab.

8. A foam output device easy to produce foam as claimed in claim 1, wherein said filter has a filter main body and a filter net to be integrally formed on an upper end of said filter main body by injection molding.

9. A foam output device easy to produce foam as claimed in claim 1, wherein an air intake clearance is formed between an outer wall of said nozzle and said assembly part of said nozzle seat; an annular clamping piece being formed at the inside of said nozzle and said clamping piece having a hook part provided at a bottom edge of said clamping piece; an annular coupling tab being formed to extend upwardly from said partition plate of said nozzle seat, said coupling tab has a hook portion provided at an upper edge of said coupling tab; said clamping piece being used to clamp said coupling tab and said hook part provided at the bottom edge of said clamping piece being in hooking engagement with the hook portion provided on said coupling tab.

* * * * *